United States Patent [19]

Idoni

[11] 3,985,010

[45] Oct. 12, 1976

[54] METHOD AND APPARATUS FOR DECODING TWISTING TUMBLER LOCK AND TWISTING TUMBLER LOCK RESISTANT THERETO

[75] Inventor: Robert A. Idoni, New Rochelle, N.Y.

[73] Assignee: Lock Technology, Inc., New Rochelle, N.Y.

[22] Filed: Oct. 21, 1974

[21] Appl. No.: 516,466

[52] U.S. Cl. ..... 70/364 A; 70/378; 70/394; 70/419

[51] Int. Cl.[2] ..... E05B 19/20; E05B 27/04

[58] Field of Search ..... 70/321, 322, 364 R, 70/364 A, 376–378, 394–399, 416, 419, 421; 33/174 F

[56] References Cited

UNITED STATES PATENTS

| | | | |
|---|---|---|---|
| 3,604,231 | 9/1971 | Buschi | 70/363 |
| 3,722,240 | 3/1973 | Spain | 70/364 A |
| 3,827,151 | 8/1974 | Naill | 33/174 F |

*Primary Examiner*—Robert L. Wolfe
*Attorney, Agent, or Firm*—Hubbell, Cohen, Stiefel & Gross

[57] ABSTRACT

Method and apparatus for decoding twisting tumbler lock of the type wherein side bar is sole locking element and normally bridges shear plane unless radial apertures in twisting tumblers are all in vertical and horizontal register with complementary side bar protrusions. Decoding apparatus comprises three devices each with a blade insertable in keyway and having upwardly and rearwardly sloping front surface angulated at one of three angles to which tumblers must be twisted for horizontal registration of apertures. Each blade has indicia for indicating that front surface is at particular tumbler and further has indicia for determining amount of elevation of tumbler resulting from camming action between chisel shaped tumbler bottom and blade front surface when blade is advanced from initial engagement with tumbler to elevate tumbler. Method includes step of torquing blade during advancement to bias side bar toward tumblers and thus force protrusion into associated tumbler aperture when aperture registers with protrusion. This movement causes small but detectable resistance to further advancement and, thus, yields positive indication of registration. As angle of front surface is known and required tumbler elevation is known, tumbler is decoded. By repeating process with all tumblers, lock is decoded.

3 Claims, 10 Drawing Figures

METHOD AND APPARATUS FOR DECODING TWISTING TUMBLER LOCK AND TWISTING TUMBLER LOCK RESISTANT THERETO

BACKGROUND OF THE INVENTION

1. Field of the Invention

This invention relates to twisting tumbler locks and particularly to twisting tumbler locks as manufactured by Medeco Security Locks, Inc. of Salem, Virginia. Most particularly this invention relates to twisting tumbler cylinder locks manufactured by Medeco Security Locks, Inc. and designated as a "cam or switch lock".

2. Description of the Prior Art

Locks of the twisting-tumbler type are typified by the lock described and claimed in U.S. Pat. No. 3,499,302 granted to R. C. Spain et al. on Mar. 10, 1970, for cylinder lock, which patent is hereby incorporated by reference in its entirety. Such patent describes a cylinder lock having a cylinder shell and a key plug rotatably mounted therein. Slidably mounted in the key plug are a plurality of transversely extending tumblers each of which has a chiseled shaped bottom and a vertically extending groove. Above the tumblers are drivers. A key is inserted in the keyway of such lock, which key is bitted so as to cause the upper ends of the tumblers to all rest in the shear plane of the lock. However, the vertical positioning of the tumblers as above described does not necessarily unlock the lock described in the aforementioned Spain et al. patent. In addition to the vertical positioning, the Spain et al. patent requires that each of the tumblers be rotatably positioned to a particular angular position whereby to permit the movement into said vertically extending grooves of protrusions on a transversely movable side bar which side bar, in its extended position, extends across the shear plane of the lock to prevent rotation of the key plug relative to the cylinder shell. However, when all of the tumbler grooves are in alignment with their associated side bar protrusions, the side bar is free to move out of the shear plane of the Spain et al. lock whereby to unlock the lock, assuming the appropriate vertical positioning of the tumblers.

A lock of the type described by Spain et al. in the said aforementioned patent is commercially available under the trademark MEDECO as a mortise or rim cylinder lock and such a lock, somewhat modified from that structure described in the aforementioned patent, is described in a patent application of even date filed by the inventor hereof and George V. Iaccino, which application bears the same title as the title of the present application and is hereby incorporated by reference in its entirety.

As is true in both the Spain et al. patent previously mentioned and in the commercially available mortise and rim cylinder locks manufactured by Medeco Security Locks, Inc., the key plug is locked separately by two separate mechanisms, one being the bridging of the shear plane by the drivers and the other being the bridging of the shear plane by the side bar. Medeco Security Locks, Inc. manufactures a second form of lock commonly referred to as a cam or switch lock. This lock, which also operates on the twisting tumbler principle of the cylinder lock described in said Spain et al. patent, differs from the locks described in said patent and from the Medeco mortise and rim cylinder locks commercially available in that the vertical position of the tumblers does not directly provide a lock to prevent rotation between the key plug and the cylinder. The only lock in the cam or switch lock manufactured by Medeco Security Locks, Inc. is due to a bridging of the shear plane by the side bar. However, the vertical positioning of the tumblers is still critical to the unlocking of the lock, as is ture in the more common mortise and rim cylinder locks of Medeco, by virtue of the replacement of the tumbler grooves in the mortise and rim cylinder locks by a small radially extending holes in each tumbler in the cam or switch lock. The holes must receive the associated protuberance of the side bar in order to permit the side bar to move inwardly out of bridging relation with the shear plane and thus unlock the key plug from the lock cylinder shell. Since a small aperture is employed in the cam or switch lock, it will be obvious to those skilled in the art that the aperture must be vertically registered with its associated side bar protuberance as well as angularly registered therewith, whereby to cause the lock to require a key having bits with both the proper angulation and depth of bit cut as is true in the locks of the Spain et al. patent.

In the aforementioned application of even date, filed by the inventor hereof and his co-inventor George V. Iaccino, methods and apparatus for decoding Medeco locks sold as mortise and rim cylinder locks which locks are quite similar to the locks described and claimed in said aforementioned Spain et al. patent have been described and claimed. However, the methods and apparatus described therein are dependent in part at least on the presence of the longitudinally or vertically extending grooves in each of the tumblers, which grooves provide a hooking abutment for the angulation decoding method and apparatus described in said application of even date. Since such groove is not present in the cam or switch lock of the twisting tumbler type manufactured by Medeco Security Locks, Inc., the methods and apparatus of said co-pending application of Iaccino and Idoni will not operate on the Medeco cam and switch locks.

The present invention is directed to a separate method and apparatus for decoding such cam or switch locks manufactured by Medeco. The present invention is also directed to a modified form of cam or switch lock which will defeat the method and apparatus for decoding the standard Medeco cam and switch lock.

DETAILED DESCRIPTION OF THE PREFERRED EMBODIMENTS

Figure 1:
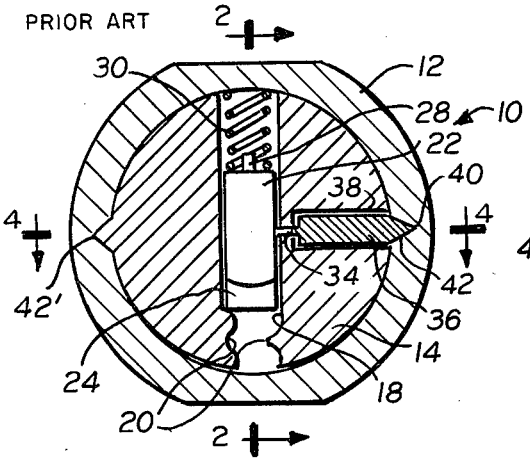
FIG. 1. PRIOR ART
FIG. 1 is a transverse sectional view of a commercially available cam or switch lock as manufactured by Medeco Security Locks, Inc. of Salem, Virginia.

Referring now to the drawings in detail and particularly to FIGS. 1–4 thereof, a twisting tumbler lock of the type currently manufactured by Medeco Security Locks, Inc. of Salem, Virginia and designated as a cam or switch lock is illustrated. This lock is in the prior art and is commercially available to the public and to the skilled art worker. Such a lock is generally designated by the reference numeral 10 and comprises a lock cylinder shell 12 in which is rotatably mounted a key plug 14, the confronting cylindrical surfaces between them being designated as the "shear plane". As is customary in pin tumbler locks, the key plug 14 has a plurality of circular apertures 16 distributed along the longitudinal axis thereof, here shown to be five in number, although other numbers may be employed. Extending longitudinally of the key plug and in communication with each of the apertures 16 is a keyway 18 preferably with ridges and grooves 20 as is customary in the art. In order for a key (not shown) to be inserted in the keyway 18, it must have grooves and ridges complementary to the ridges and grooves 20. Slidably and rotatably mounted in each of the apertures 16 in key plug 14 is a pin tumbler 22 each of which is provided with a chisel shaped bottom 24 and a small radially extending aperture 26 in the side thereof. At the upper end of each of the pin tumblers 22 is preferably a small axially extending post 28 which provides a seat for a compression spring 30 abutting against the top of the pin tumbler and against the inner surface of the shell 12. The springs 30 bias the pin tumblers downwardly into the keyway 18 as again is customary and well known. When a key with bits of appropriate depth is inserted into the keyway 18, the pin tumblers 22 will all be shifted vertically to predetermined positions as will become apparent hereinafter. Each of apertures 16 has a groove 29 in which is disposed a protrusion 31 at top of tumblers for limiting angle of twist of tumblers.

All that has been described hereinbefore is similar, although not identical to conventional pin tumber locks, and is substantially identical to the locks described and claimed in U.S. Pat. No. 3,499,302 granted to R. C. Spain et al. on Mar. 10, 1970 for cylinder lock, which patent is hereby incorporated by reference in its entirety to give the reader hereof a complete understanding of the underlying concepts of the now well known twisting tumbler lock.

What separates the lock 10 from the locks described in said aforementioned Spain et al. patent is that in lieu of the longitudinally extending tumbler grooves or gates 69 as appear in the Spain et al. patent, the tumblers 22 of the present lock each have a small radially extending hole 32 for receiving an associated protrusion 34 on a side gate 36 that is slidably mounted in a slot 38 in the key plug 14. Normally the protrusions 34 of the side gate 36 rest on the sides of the tumblers 22 and are prevented thereby from moving inwardly away from the shell or leftwardly as viewed in FIG. 1 of the drawings. Thus, the engagement of the protrusions 34 with the side walls of the tumbler 22 causes the side bar to bridge the shear plane and holds the V-shaped outer end 40 of the side gate in the elongated V-shaped groove 42 on the inner surface of the shell 12 to thereby lock the key plug 14 against relative rotation with respect thereto. Thus, the side bar 34 provides the sole locking for the lock 10.

However, when a key having angulated bits similar to the key 24 of the aforementioned U.S. Pat. No. 3,499,302 is inserted into the keyway, if the bits of that key are cut to the proper depth whereby to vertically register the holes 32 with protrusions 34 and the facets of said bits are angulated so that when they cooperate with the chisel shaped bottoms of the tumblers 24 they will cause each of the tumblers to rotate to horizontally register the apertures 32 with the side bar protrusions 34, the side bar will be free to move towards the center of the lock with the protrusions sliding into their now registered associated holes 32 against the bias of the springs 42 that normally hold the side bar in its extended or locking position. This movement is effected by virtue of a camming action between the V-shaped notch 42 in the wall of the shell and the V-shaped configuration of the outer end 40 of the side bar 36. Thus the side bar is free to move in and permit rotation of the key plug whereby to unlock the lock.

Figure 3:
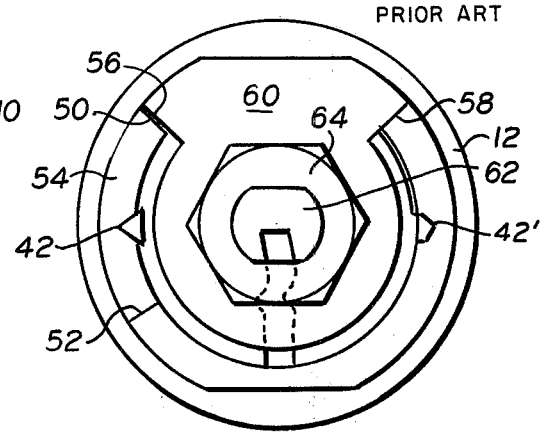
FIG. 3. PRIOR ART
FIG. 3 is a rear elevational view thereof.
Figure 2:
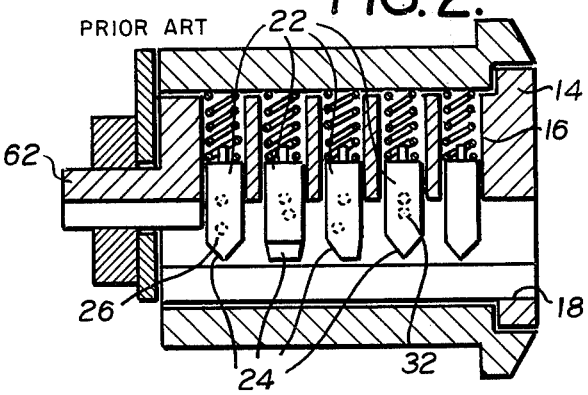
FIG. 2. PRIOR ART
FIG. 2 is a longitudinal sectional view of said lock taken along the line 2—2 in FIG. 1.
Figure 4:
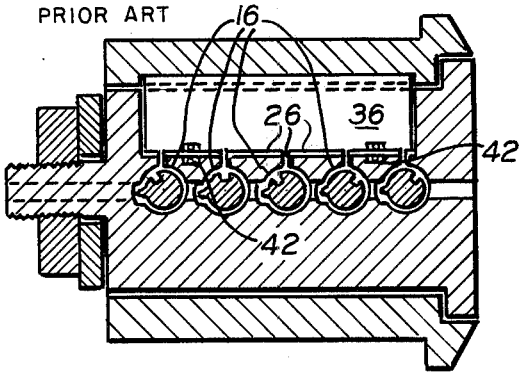
FIG. 4. PRIOR ART
FIG. 4 is a horizontal longitudinal sectional view taken along the line 4—4 in FIG. 1.

As presently marketed and as illustrated in FIG. 3, the cam and switch lock 10 has two lock positions for the plug 14 relative to the shell 12, which two positions are 180° from one another and are defined on the one hand by the faces 50 and 52 of a longitudinally extending abutment 54 on the shell 12, and on the other hand by faces 56 and 58 of a stop member 60 secured to the non-circular threaded extension 62 at the rear end of the plug 16 as by a hexagonal nut 64. When the faces 50 and 56 are in engagement as shown in FIG. 3, then the side bar 36 is in alignment with the groove 42, whereas when the faces 52 and 58 are in engagement, whereby to orient the plug 180° away from the the first mentioned orientation, then the side bar 36 will be in alignment with groove 42'.

Figure 5:
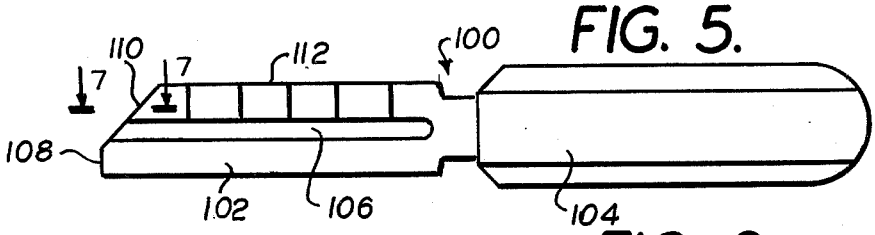
FIG. 5 is a side elevational view of a device for decoding the lock of FIGS. 1 – 4.
Figure 6:
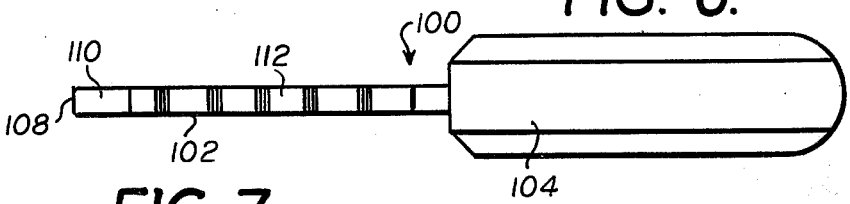
FIG. 6 is a top plan view thereof.
Figure 7:
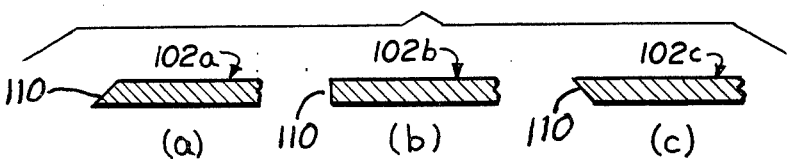
FIGS. 7(*a*), (*b*), and (*c*) are all fragmentary sectional views taken along the line 7—7 in FIG. 6 and illustrating the three forms of the device shown in FIGS. 5 and 6.

Because the lock 10 has two independent variables for locating each of the tumblers in its unlocked position, the variables being first the depth of cut of the individual bits on the key and second the angulation of said bits, the lock 10 is highly resistant to conventional picking which normally operates to shift only the vertical position of the tumbler and not its angular position. This being the case, upon the eventuality of a lockout arising from a misplaced key or the like, normally the lock 10 cannot be opened except by destroying either it or the door in which it is mounted. Such destruction is clearly undesirable, costly and preferably to be avoided by skilled locksmen. The present invention is directed to new methods and apparatus for decoding a lock such as the cam or switch lock manufactured by Medeco Security Locks, Inc., as heretofore described in connection with FIGS. 1–4, so that either a new key can be cut for the lock or the technique of inserting precut key bits may be employed in order to open the lock without destruction. The device for decoding the lock 10 is illustrated in FIGS. 5, 6 and 7 and is generally designated by the reference character 100. The device 100 comprises a blade 102 fixedly secured to a handle 104. The blade 102 is configured like a key blank for insertion into the keyway 18 of the lock 10. That is to say, the side surfaces of the blade 102 are provided with grooves 106 or ridges, as may be required to make the cross sectional configuration of the blade 102 complementary to and insertable in the keyway 18. The configuring of the blade 102 conforms to a key blank as well as adjacent the front where the front edge is defined by a substantially upstanding portion 108, and an angularly extending portion 110 that terminates at the upper surface 112 of the blade 102. The handle may be of any desirable shape for use by hand and is here shown to be hexagonal, although round or octagonal shapes or the like would serve just as well.

As may best be seen in FIGS. 7 (*a*), (*b*) and (*c*), no one device 100 can of itself normally serve to decode lock 10. In fact, there are three devices 100 necessary to make up a decoding kit for the lock illustrated in FIGS. 1–4, which devices are identical in all respects save for the angulation of the sloping surface 110 at the front of the blade. Thus, if the instrument 100 is provided with a blade 102*a*, then upon the surface 110 of the blade 102*a* engaging the chisel-like bottom 24 of a tumbler 22, it will turn the tumbler 22 counterclockwise or rightward as viewed in FIG. 4, whereas an instrument 100 having a blade 102*b* would align the chisel shaped bottom of a tumbler perpendicular to the longitudinal axis of the keyway. On the other hand, if the insturment 100 has a blade 102*c*, then upon the surface 110 of blade 102*c* engaging the chisel shaped bottom of a tumbler 22, it will rotate the tumbler counterclockwise or leftward as used in FIG. 4.

As would be understood from the previous description of lock 10 in connection with FIGS. 1–4, the angular location of the apertures 42 in the tumblers 22 relative to the transverse axis defined by the chisel shaped bottom determines the appropriate angular position of the tumbler for bringing the apertures 32 into horizontal alignment with their associated protrusions 34 on the side bar 36. Likewise, the depth of cut serves to bring the apertures into vertical alignment with said protrusions. The surface 110 slopes upwardly so as to cam the tumblers 22 upwardly and thus serves as a variable depth bit in terms of decoding the depth of bit necessary for each tumbler. If the tumbler bottom engages the surface 110 at the right point thereon, then the aperture 32 will be in vertical alignment with the protrusion 34 on the side bar 36 associated therewith. Likewise, if the angulation of the surface 110 is the proper angulation, then the engagement of the surface 110 with the chisel shaped bottom 24 of the tumbler 22 will rotate the tumbler so as to bring the aperture 32 into horizontal alignment with the associated protrusion 34 of the side bar 36. Accordingly, if an instrument 100 having the appropriate angulated blade surface 110 is brought into engagement with a correspondingly angulated tumbler 22, it can, by the degree of insertion of the blade 102 into the keyway 18, shift the tumbler vertically to align the aperture 32 with its associated protrusion 34 and thus bring the tumbler into its unlocked position.

Given the above as a background, the method of decoding the lock 10 is to first select a decoding device 100 of any type such as that having a blade 102*a*. The blade 102*a* is inserted into the keyway 18 of the lock 10 until the first indicium 114*a* of a group of indicia 114 on the side of the blade is brought into alignment with the front surface 115 of the key plug 14. At this point the user of the implement 100 will apply a torque to the implement and hence to the plug 16. At the same time, the user will slowly advance the blade 102 into the keyway 18 until he detects a positive resistance to further insertion of the blade 102 into the keyway. Such resistance is a result of the protrusion 34 on the side bar 36 associated with the particular tumbler being decoded moving a very short distance into the aperture 32 in said tumbler whereby to catch the tumbler and resist further upward movement thereof. The resistance is not great but it is discernible by a locksmith of ordinary skill. When the resistance is encountered, the user of the implement 100 will view the indicia 116 at the top of the blade 102*a*, which indicia are in groups of lines, and each group being of a number of lines which corresponds to the number of different vertical positions to which the tumbler might be moved by an ordinary angled bitted key. In the Medeco lock described in connection with FIGS. 1–4, there are four such different levels. Thus each group of indicia 116 comprises four separate closely spaced apart parallel indicia corresponding to the possible appropriate depths of insertion of the blade for moving the chisel shaped tumbler to the appropriate vertical position. It will be obvious that each of the sets of indicia 116 are associated with each of the particular tumbler positions as initially indexed by the indicia 114. Thus after the instrument 100 with the blade 102*a* has been employed to decode the tumbler in the first or outermost position, it may be withdrawn and then inserted more rapidly past the first member until the second indicia 114 is registered with the front surface 115 of the key plug and the method 13 then repeated at that point with the second tumbler 22. Clearly, the blade 102*a* will not operate for all tumblers since one of the essence of the Medeco lock is to have tumblers that require different angulations in order to unlock the lock. Thus, if for example, the blade 102*a* is not suitable for decoding the first tumbler, then it will be necessary to repeat the method with a second device 100 having either the blade 102*b* or 102*c*, for example, 102*b*. As will be seen, blade 102*b* has a surface 110 that is perpendicular to the longitudinal axis of the blade. Assuming it is still the first tumbler that need be decoded, the instrument 100 with the blade 102*b* is inserted into the keyway until the indicium 114*a* on the side of the blade 102*b* registers with the surface 115 at the front of the key plug 16. In this position, the user applies a torque to the handle 104 and commences to progress the blade 102*b* slowly into the keyway to detect resistance to further advancement to the blade 102*b*.

Assuming the transverse cut of the blade 102*b* is the appropriate cut, then aperture 32 will be horizontally registered with its associated side bar protrusion 34, but not vertically registered therewith. As the blade 102*b* is gradually advanced in the keyway past the first or lefthand set of indicia 116, at some point the tumbler 22 will be elevated to bring its aperture 32 into vertical register with the associated protrusion 34 on the side bar 36. At that point, the protrusion will move a slight distance into the aperture 32 to catch tumbler 22 and cause a resistance to further upward movement of the tumbler which resistance will translate itself into resistance to further inward movement of the blade 102*b*. At the point the resistance is encountered, the user will determine which of the indicia in the indicia group 116 associated with the tumbler being decoded is in alignment with the front surface 115 of the key plug 14 and this indicia will determine the depth of cut for the bit to be associated with the tumbler. Clearly, if there is no catching of the protrusion by the aperture of the tumbler, then the angulation of the blade 102*b* is not the appropriate angulation for the tumbler being decoded and another instrument 100 with blade 102*c* must be substituted and the process repeated to decode the tumbler.

In practice, it has been found preferable to progressively employ one of the devices 100 on all of the tumblers, be there four, five or six of such tumblers, to decode the tumblers with the appropriate angulation for the one blade. Thereafter, a second device 100 having a blade of different angulation is chosen to decode those tumblers which have not been decoded by the first implement. Finally, if all the tumblers are yet not decoded, the user would select the third implement 100 with the third angulation on the surface 110 and decode the remaining tumblers as to depth of bit and angulation thereof.

It will be obvious that rather than employing three separate devices 100 each of which has a blade 102 affixed to a handle 104, a single handle 104 could be employed in which the blade 102 is removably positionable, the decoding kit thereupon comprising one handle 104 and three blades 102*a*, 102*b* and 102*c*.

By employing the devices 100, it will be seen that when the appropriate code is obtained for a particular tumbler, both the angle and the depth of bit are determined simultaneously. The user can record the appropriate code for the tumbler and perform this in sequence so that the entire lock is decoded. Once the lock is decoded, the user can go to a locksmith shop and have the key cut. In the alternative, the user may employ a portable key cutting machine such as described and named in U.S. Pat. No. Re 27,665 granted to R. C. Spain et al. on June 12, 1973 to cut the decoded key right in the field and thereby open the lock. Finally, in the alternative, the user can employ a kit with a multiplicity of key bits which are cut to every conceivable depth and every conceivable angle employed in such locks 10 and these bits can be slid into the keyway in appropriate sequence to thereby operate the tumblers to the proper height and angulation so as to open the lock. The method of employing the segmented bits is described in detail in the previously incorporated application of even date filed by George V. Iaccino and Robert A. Idoni.

The method and apparatus above described in connection with FIGS. 5–7 are clearly dependent upon the user being able to sense a resistance to further insertion of the appropriately angulated blade 102 when the tumbler being decoded is positioned so that its aperture 32 registers with its associated side bar protrusion 34. As already noted, that resistance is due to a catching of a small portion of the protrusion 34 in its associated tumbler aperture 32. This being the case, it is recognized that under certain circumstances, it may be desirable to provide a lock of the type shown in FIGS. 1–4, which lock would resist even the decoding method heretofore described and illustrated in connection with FIGS. 5–7. When such resistance is desired, the lock 10 of FIGS. 1–4 may be modified to avoid the decoding method and apparatus. Such modification is in the details of construction of the side bar 36 and such a modified side bar which if retrofitted into the lock 10 as a substitute for the side bar illustrated therein would result in a lock that could not be decoded by the method hereinbefore described. This side bar is illustrated in FIG. 8 and is generally designated by by the reference character 36′.

The side bar 36′ is in all respects identical to the side bar 36 of FIGS. 1–4 save for the fact that the protrusions 34′ thereof are not all of the same length. Specifically, at least one, and preferably several of the protrusions 34′ are shorter than the others. This being the case, it will be obvious to those skilled in the art that when the decoding method and apparatus hereinbefore described are employed on a lock 10 incorporating the modified side bar 36′ of FIG. 8, when a tumbler associated with a short side bar protrusion 34′ is attempted to be decoded, the decoding will be unsuccessful because the protrusion will not be long enough to move into the registered aperture of the tumbler being decoded and hence will not provide the necessary resistance to advancement of the blade 102 that indicates that registration has been achieved. With the user unable to determine that he has in fact achieved registration of the aperture 32 with the side bar protrusion 34′, that tumbler cannot be decoded. It will be obvious that the short of protrusions 34′ of the side bar 36′ will be held away from the surface of the tumbler being decoded by the longer protrusions 34′ engaging the surfaces of their associated tumblers to thereby hold the side bar in a fully retracted position.

Figure 8:
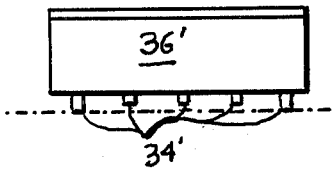
FIG. 8 is a top plan view of a modified form of side bar for the lock of FIGS. 1–4 which will resist the decoding apparatus of FIGS. 5–7 and the method of employing same.

As shown in FIG. 8, and viewed from the left, it will be seen that the first and fifth protrusions 34′ are longer than the remaining protrusions which may be designated as the second, third and fourth as viewed from the left of FIG. 8. This illustration is purely arbitrary and any combination of protrusions of different lengths will suffice to resist the techniques hereinbefore described. There is some advantage to having the first and fifth protrusions 34′ longer than the intervening three whereby to provide for three tumblers that cannot be decoded and yet providing a stable engagement of two widely separated points for holding the side bar in its retracted or locking position.

It will also be obvious to those skilled in the art that the indicia 116 will be relatively close to one another when employed on a device 100 for use in decoding the commercially available locks manufactured by Medeco Security Locks, Inc. as cam or switch locks. Due to the closeness of indicia in each set 116, there may be some difficulty encountered in reading these indicia. If this is the case, it will be obvious that some form of magnification device can be employed in connection with the device 100 to facilitate the appropriate reading of the indicia 116.

While I have herein shown and described the preferred form of the present invention, and have suggested modifications thereof, other changes and modifications may be made therein within the scope of the appended claims without departing from the spirit and scope of this invention.

What is claimed is:

1. In a method of decoding a twisting tumbler lock of the type including a cylinder shell, a key plug rotatably mounted in said cylinder shell and having a longitudinally extending keyway therein, a plurality of transversely extending longitudinally spaced tumblers slidably and rotatably mounted in said key plug, each of said tumblers having a chisel shaped bottom disposed in said keyway and a radially extending aperture in the periphery thereof located at one of a predetermined number of different angles to the axis of said chisel shaped bottom and at one of a predetermined number of different distances from said bottom, and a longitudinally extending transversely movable side bar having a plurality of protrusions, one for each tumbler, movable into said tumbler apertures, means for biasing said side bar into bridging relation with the shear plane of said lock, said side bar being permitted to move out of said bridging relation when all of said tumbler apertures are in horizontal and vertical register with said side bar protrusions, said apertures being horizontally registered with their associated protrusions when the chisel shaped bottom of said tumbler engages a key bit surface angulated at a preselected one of said predetermined angles and being vertically registered when said tumbler bottoms engage bits of predetermined depths of cut, said method comprising the steps of:

inserting into said keyway a blade having an upwardly and rearwardly sloping front surface which is angulated at the preselected angle for a tumbler being decoded to angularly orient said tumbler to horizontally register the aperture of said tumbler with its associated side bar protrusion until it engages said tumbler;

applying torque to said blade, and while maintaining said torque advancing said blade further into said keyway in engagement with said tumbler to twist said tumbler to register its radially extending aperture with its associated side bar protrusion to thereby cause engagement between said aperture and said protrusion whereby to result in resistance to further advancement of said blade; and then determining the distance of said advancement.

2. The method of claim 1, further comprising repeating said steps for each tumbler in said lock.

3. Apparatus for decoding a twisting tumbler lock of the type including a cylinder shell, a key plug rotatably mounted in said cylinder shell and having a longitudinally extending keyway therein, a plurality of transversely extending longitudinally spaced tumblers slidably and rotatably mounted in said key plug, each of said tumblers having a chisel shaped bottom disposed in said keyway and a radially extending aperture in the periphery thereof located at one of a predetermined number of difangles to the axis of said chisel shaped bottom and at one of a predetermined number of different distances from said bottom, and a longitudinally extending transversely movable side bar having a plurality of protrusions, one for each tumbler, movable into said tumbler apertures, means for biasing said side bar into bridging relation with the shear plane of said lock, said side bar being permitted to move out of said bridging relation when all of said tumbler apertures are in horizontal and vertical register with said side bar protrusions, said apertures being horizontally registered with their associated protrusions when the chisel shaped bottom of said tumbler engages a key bit surface angulated at a preselected one of said predetermined angles and being vertically registered when said tumbler bottoms engage bits of predetermined depths of cut, said apparatus comprising a number of devices corresponding to the number of different angles said radial apertures are disposed to said chisel shaped bottoms, each of said devices including:

a blade slidably insertable into said keyway, said blade having an upwardly and rearwardly sloping front surface angulated at one of said angles;

means for indicating the positioning of the front surface of said blade adjacent each of said tumblers; and means for indicating the amount of unobstructed advancement of said blade into said keyway while said front surface is in engagement with each of said tumblers.

* * * * *